United States Patent [19]

Guidry et al.

[11] Patent Number: 4,510,797

[45] Date of Patent: Apr. 16, 1985

[54] FULL-BORE DRILL STEM TESTING APPARATUS WITH SURFACE PRESSURE READOUT

[75] Inventors: Shelby L. Guidry, Houston, Tex.; Perry J. DeCuir, Sr., New Iberia, La.

[73] Assignee: Schlumberger Technology Corporation, New York, N.Y.

[21] Appl. No.: 422,246

[22] Filed: Sep. 23, 1982

[51] Int. Cl.[3] ..... E21B 47/00

[52] U.S. Cl. ..... 73/151; 340/856; 339/117 R; 166/250

[58] Field of Search ..... 340/856, 857; 166/250; 73/151; 339/117 R

[56] References Cited

U.S. PATENT DOCUMENTS

| | | | |
|---|---|---|---|
| 3,696,332 | 10/1972 | Dickson, Jr. et al. | 73/151 |
| 3,879,097 | 4/1975 | Oertle | 340/856 |
| 3,939,705 | 2/1976 | Glotin et al. | 73/151 |
| 3,957,118 | 5/1976 | Barry et al. | 340/856 |
| 4,095,865 | 6/1978 | Denison et al. | 339/117 R |
| 4,220,381 | 9/1980 | van der Graff | 340/856 |

*Primary Examiner*—Howard A. Birmiel

[57] ABSTRACT

In accordance with an illustrative embodiment of the present invention, a full-bore drill stem testing system includes a lower housing member having a ball valve for opening and closing a flow passage extending axially therethrough and an upper housing member having an open axial bore in communication with said flow passage. Downwardly facing recesses are formed in the wall of the upper housing member laterally offset from the open bore, and each recess receives an electrical contact that is connected with transducer means for sensing variables such as pressure and temperature of well fluids below the ball valve. Guide slots having orienting surfaces at their lower ends lead upwardly to each recess. A running tool that is lowered into the upper housing member on electrical wireline has normally retracted arms which carry electrical contacts on their upper ends. The running tool is actuated upon engagement with a stop shoulder in the upper housing member to cause extension of the arms, whereupon the running tool is shifted upwardly to cause the upper ends of the arms and the contacts thereon to be oriented and guided by the slots into engagement with the contacts in the recesses. The electrical connections thus made enable surface readout of the downhole measurements as the drill stem test proceeds.

26 Claims, 9 Drawing Figures

FULL-BORE DRILL STEM TESTING APPARATUS WITH SURFACE PRESSURE READOUT

FIELD OF THE INVENTION

This invention relates generally to drill stem testing, and particularly to a new and improved drill stem testing system of the full-bore type having means enabling surface readout of downhole measurements while the tool string remains in the well.

BACKGROUND OF THE INVENTION

In conventional drill stem testing a packer and a normally-closed test valve are lowered into the well bore on a pipe string, and the packer is set to isolate a formation interval to be tested. The test valve is opened and then closed for respective flow and shut-in periods of time, during which changes in fluid pressure in the well bore below the valve are recorded by a gauge. The pressure data normally is not available for inspection or analysis until the test tool string including the gauge is withdrawn from the well.

Drill stem testing systems have been proposed that enable a concurrent surface indication of conditions measured downhole while the test is underway. Examples of such systems are shown in U.S. Pat. Nos. 2,607,220 and 3,041,875. A surface readout is, of course, desirable from the standpoint of being able to determine whether the durations of the flow and shut-in periods have been sufficient, as well as providing immediate detection of tool plugging or other malfunction. However, in accordance with the disclosure of the above-mentioned patents, and as employed in certain drill stem testing systems in current use, the electrical connection through which signals are fed to the surface via cable is mounted on the test tool in alignment with the center of the tubing bore. This fact, together with the type valve employed, blocks vertical access through the tool string so that it is not possible to run a wireline tool such as a perforating gun therethrough. This capability requires the use of a so-called "full-bore" test tool that includes a ball or flapper type valve which provides for straight vertical access through the tool when moved to the open position. Although full-bore test tools are known, none of the prior structures that applicants are aware of have any provision that enables surface readout of downhole measurements while the testing is in progress.

It is accordingly the general object of the present invention to provide a new and improved full bore drill stem testing apparatus including means enabling a concurrent surface readout of measurements made downhole while the test is in progress.

SUMMARY OF THE INVENTION

This and other objects are obtained in accordance with the concepts of the present invention through the provision of a well testing apparatus comprising upper and lower tubular housing members adapted for connection to a pipe string extending upwardly to the surface. The lower housing member carries a full-opening valve, such as a ball valve or the like, for opening and closing a flow passage extending axially therethrough. The upper housing member has an open axial bore in communication with the flow passage of the lower housing member, and a downwardly facing recess in the wall thereof laterally offset from the open bore. A first electrical contact is mounted in the recess and is electrically connected with means including a transducer for sensing a variable such as pressure in the flow passage below the full opening valve. A guide extends along the wall of the upper housing member below said recess and is arranged to orient and guide a second electrical contact upwardly toward the recess and into engagement with the first electrical contact.

The second electrical contact is mounted on the upper end of a retractable arm which is carried on a running tool that is adapted to be lowered into the pipe string from at the surface on an electrical cable. The running tool includes an inner body section that is telescopically disposed within an outer body section, with the arm being pivotally connected to the outer body section in a manner such that the upper end thereof is movable between retracted and extended positions. The upper end of the arm is urged toward the extended position, however a locking means is provided for normally preventing such outward movement. The locking means is arranged to be released in response to downward movement of the inner body section relative to the outer body section to enable the upper end of the arm to move outwardly.

A stop is mounted in the bore of the upper housing member below the guide, and is engagable with means on the outer body section of the running tool to stop downward movement thereof and thereby enable release of the locking means by continued downward movement of the inner body section. With the pivot arm extended the running tool is elevated within the upper housing member. The upper end of the arm automatically is oriented into alignment with the guide and passes upwardly therethrough until the second electrical contact is moved into mating contact with the first electrical contact in the recess. The connection thus made provides a path for electrical signals via the cable to the surface where values of pressure can be read out as the ball valve is opened and closed during the testing operation. The running tool is constructed and arranged such that as it is again moved downwardly within the upper housing member, the electrical contacts are disengaged and the arm pivots inwardly to its retracted position so that the assembly can be withdrawn from the pipe string. When the running tool is removed the testing tool is completely "full-bore" since the first electrical contact and the associated guide and stop are completely out of the open bore of the housing members.

BRIEF DESCRIPTION OF THE DRAWINGS

The present invention has other objects, features and advantages which will become more clearly apparent in connection with the following detailed description of a preferred embodiment, taken in conjunction with the appended drawings in which.

DESCRIPTION OF A PREFERRED EMBODIMENT

Figure 1:
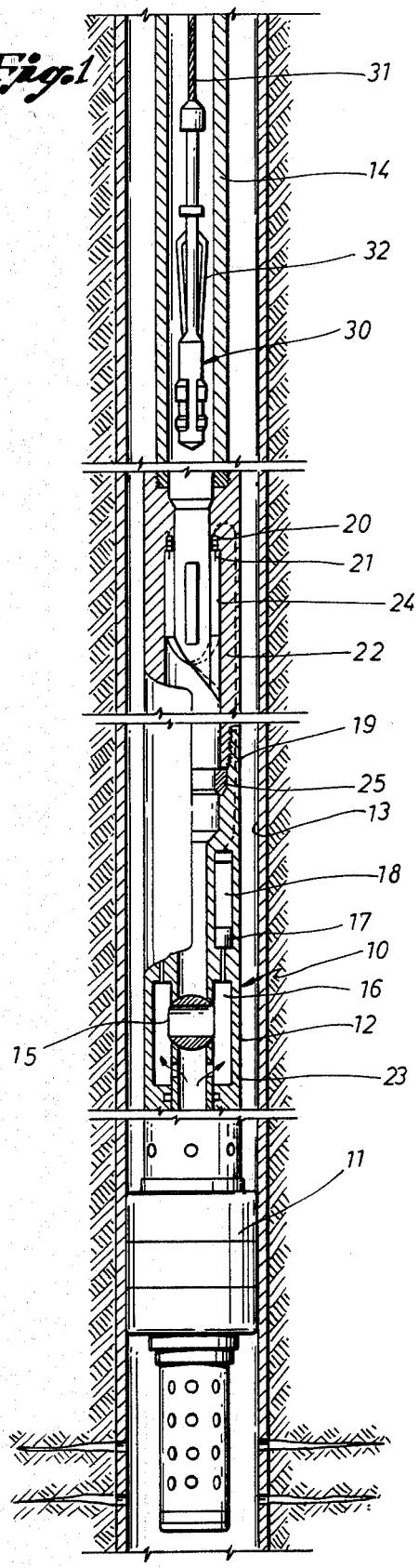
FIG. 1 is a schematic view of a drill stem testing tool string that incorporates the present invention.

Referring initially to FIG. 1, there is shown schematically a string of drill stem testing tools 10 disposed in an offshore well being tested. The string includes a packer 11 and a main test valve 12 that are run into the well bore 13 on a pipe string 14 in order to make a temporary completion of the well and to obtain pressure and other data from which various formation parameters such as permeability and natural reservoir pressure can be determined. The packer 11, which can be a typical hook-wall device, functions to isolate the formation interval to be tested from the hydrostatic head of the fluids in the well annulus thereabove. The main test valve 12 is a normally-closed, full-opening device of the type disclosed in McGill U.S. patent application Ser. No. 220,240, filed Dec. 23, 1980 (issued Apr. 3, 1984 as U.S. Pat. No. 4,440,230), incorporating a ball valve 15 that can be opened to permit fluids in the formation to flow into the well bore and up into the pipe string 14. Then the ball valve 15 can be closed to shut in the formation and enable recording by the pressure gauge of pressure build-up data which is of considerable value in connection with subsequent completion decisions. The test valve 12 as well as all the other valves in the system preferably are arranged to be actuated in response to changes in the pressure of fluids in the annulus in the manner disclosed in Nutter U.S. Pat. No. RE 29,638, and do not require pipe manipulation. This allows blowout preventers at the surface to be closed and remain closed against the pipe string at all times during the test for safety reasons. Additional components of the tool string 10 may typically include a safety joint and jar as well as a bypass valve and reverse circulating valves.

The present invention is arranged in a manner such that bottom hole pressure is directed to a location above the ball valve 15 via a passage 16 where values of pressure as well as temperatures can be sensed by appropriate transducers 17 and the values stored in a recording gauge 18. The output of the gauge 18 is fed by conductor wires 19 to one or more electrical contacts 20 located in recesses 21 in the walls of an extension housing 22 that is connected to the upper end of the tester housing 23. A guide sleeve 24 and a stop ring 25 are positioned in the housing extension 22 below the contacts 20. A running tool indicated generally at 30 can be lowered into the pipe string 14 on electrical wire line or cable 31 and inserted into the extension housing, where the running tool can be manipulated in an appropriate manner to cause connectors that are located on the upper ends of a pair of normally retracted arms 32 to be pivoted outwardly where they then are oriented and guided into mating engagement with the contacts 20 during upward movement of the running tool in the extension housing 22. When engaged, the data stored in the gauge 18 can be transmitted to the surface via the cable 31 to suitable readout and recording equipment (not shown).

Figure 2A:
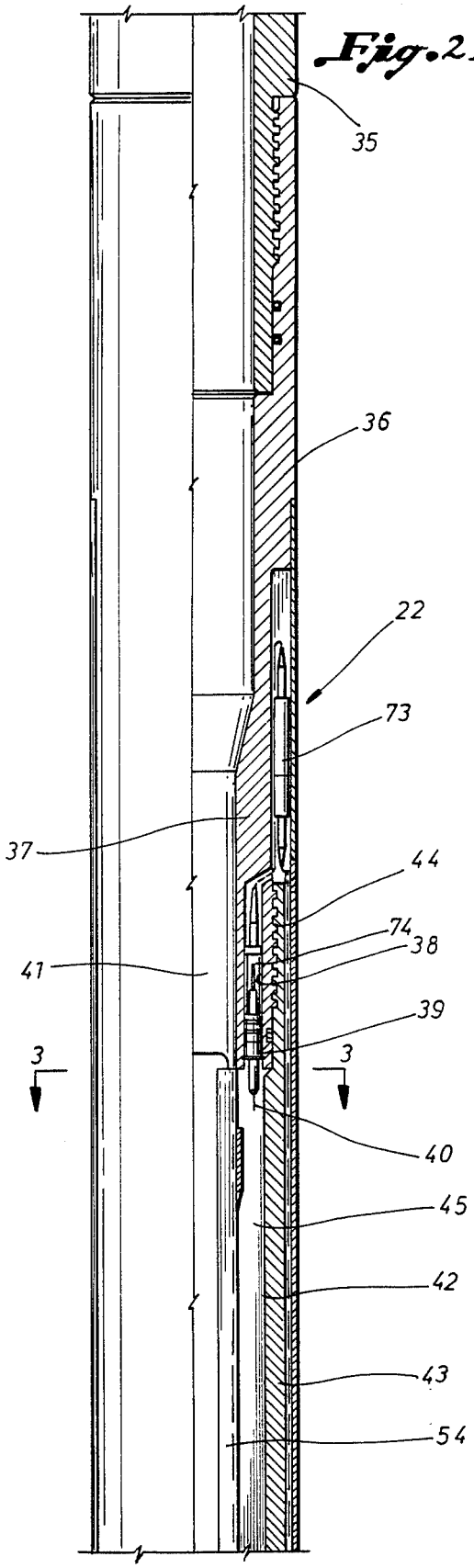
FIGS. 2A–2C are longitudinal sectional views, with portions in side elevation, of the upper housing member or receiver of the test tool apparatus.
Figure 2B:
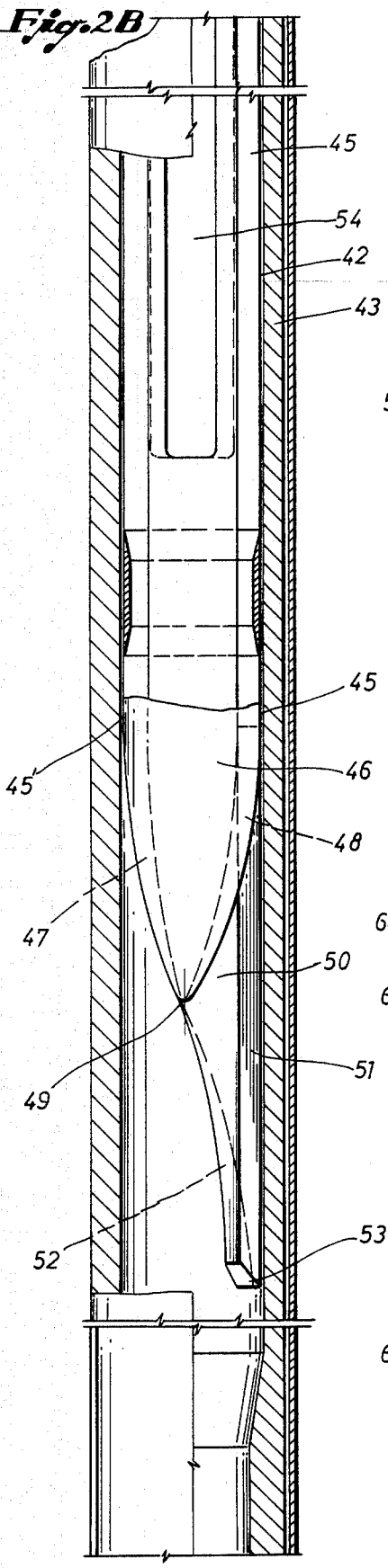
Figure 2C:
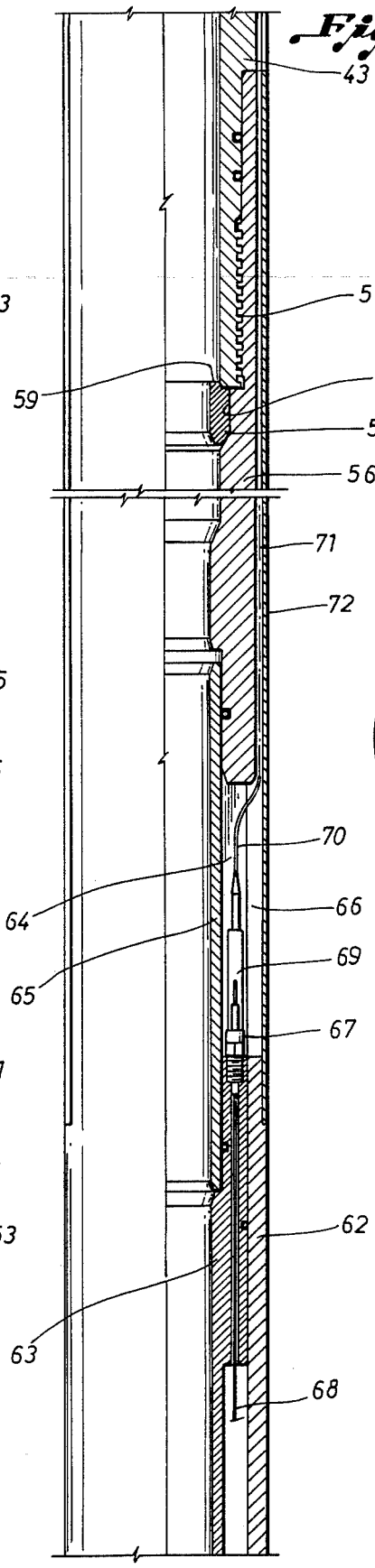
Figure 3:
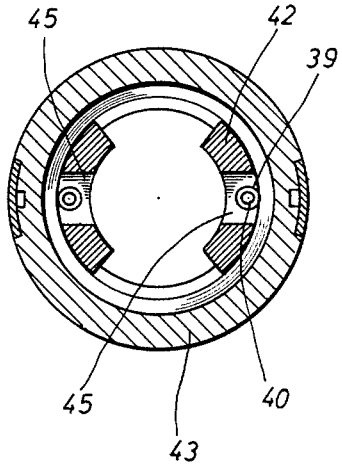
FIG. 3 is a cross-section taken on lines 3—3 of FIG. 2A.

Turning now to FIGS. 2A–2C, the extension housing assembly 22 includes a number of tubular sections that are threaded together. An upper sub 35 that is connected to the lower end of the pipe string 14 is threaded to the upper end of a receiver section 36 having an inwardly thickened portion 37. The portion 37 is provided with diametrically opposed, downwardly opening bores 38, each of which receives an electrical contact member 39 having a downwardly projecting pin 40. The contact members 39 are thus laterally offset from the open bore 41 of the housing assembly 22, which is substantially unobstructed throughout. The lower portion 42 of the receiver section 36 is reduced in outer diameter and extends downwardly within the bore of an elongated tubular housing section 43 to which the upper receiver section is connected by threads 44. The lower portion 42 has longitudinally extending channels or slots 45 cut through the wall thereof directly below each of the contact members 39, whereby the slots provide guideways leading upwardly to the contact members.

In order to rotationally orient the upper ends of the arms 32 of the running tool 30 so that they will enter the slots 45 when the running tool is actuated as will be subsequently described, the lower end of the receiver section 42 is provided with a "mule-shoe" construction as shown in FIG. 2B. The slots 45, which open through the lower end of the receiver portion 42, divide the same into front and rear generally semicircular segments. The front segment 46 is formed into a shovel-like configuration by oppositely extending helical guide surfaces 47 and 48 that extend from a rounded nose 49 to lines of intersection with the front side walls on the slots 45. The lower part of the rear segment 50 has an arcuate, generally triangular shape, which is defined by a vertical wall surface 51 that is a continuation of the rear side wall of the right-hand one of the slots 45, and a helical lower surface 52 that extends from a line of intersection with the rear side wall of the left-hand slot 45' downwardly to a beveled surface 53 adjacent the lower end of the wall surface 51. As shown in the drawings, the axial centerline of the rounded nose 49 is located well above the beveled edge 53. Moreover, the lowermost point of the nose 49 is angularly offset and located somewhat less than 90° from the radial centerline of the left-hand slot 45. Thus when the arms 32 of the running tool 30 are extended and being moved upwardly within the bore 41 of the receiver housing, they will be automatically oriented in a manner such their upper ends will enter the slots 45. Assuming, for example, that the upper end of one of the arms 32 initially encounters the lower portion of the helical surface 52, such surface will act to turn the running tool counterclockwise as viewed from above so that the upper end of the opposite arm will encounter the helical surface 48. As the running tool continues to move upwardly, the surfaces will cause the arms to be guided into the respective slots 45. It can be demonstrated that the arms will be guided into the slots 45 for any random angular orientation of the running tool within the bore 41 of the housing assembly 22. The lower portion 42 preferably is provided with diametrically opposed, elongated windows 54 through the walls thereof which provide additional areas for flow of well fluids when the running tool 30 is positioned in the receiver housing in order to maintain full-flow conditions. It may be desirable to extend the window 54 that is on the same side of the sleeve portion 42 as the segment 46 downwardly to actually open through the bottom of the said segment, which would provide more flow area yet leave short helical surfaces to either side of the lower window opening adjacent the front walls of the slots 45.

The lower end of the tubular housing section 43 is threaded at 55 to the upper end of a lower housing member 56. For purposes of activating the running tool 30, a locator and stop ring 57 is received in an internal annular recess 58 and fixed thereon by the lower end face of the housing section 43 as shown in FIG. 2C. The ring 57 provides an upwardly facing "no-go" shoulder 59 that extends inwardly of the adjacent inner wall surfaces of the housing members 43 and 56 while leaving a full-bore vertical or central passage.

The lower portion 62 of the housing member 56 has an enlarged inner diameter and is fitted around an inner tubular member 63. The annular region above the upper end of the inner member 63 provides a cavity 64 which is segregated from the bore 41 by a seal sleeve 65. A radially extending window 66 through the wall of the housing member 56 provides access to the cavity 64. A pair of plugs 67 are threaded into the upper end of the member 63 and are connected to conductor wires 68 that lead to the gauge 18 and transducers 17 located therebelow. Sockets 69 that mate with the plugs 67 are connected to conductor wires 70 that extend upwardly along the outside of the housing assembly 22 in a groove 71 which is covered by a plate 72 in order to protect the wires in the well. The upper ends of the conductor wires 70 are connected by junctions 73 (FIG. 2A) to wires that lead to the sockets 74 which mate with the contact members 39.

Figure 4:
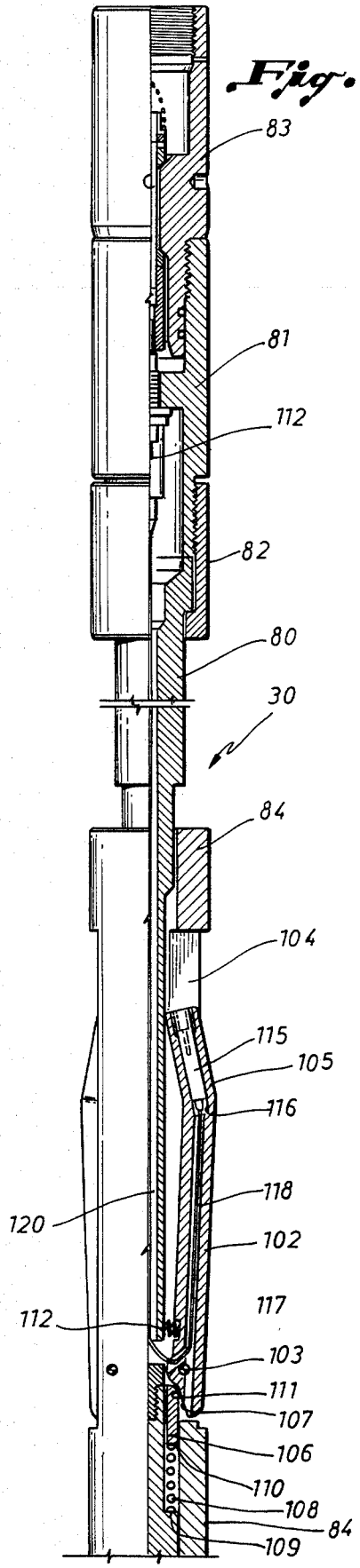
FIGS. 4A and 4B are longitudinal sectional views, with portions in side elevation, of the running tool apparatus of the present invention.
Figure 4B:
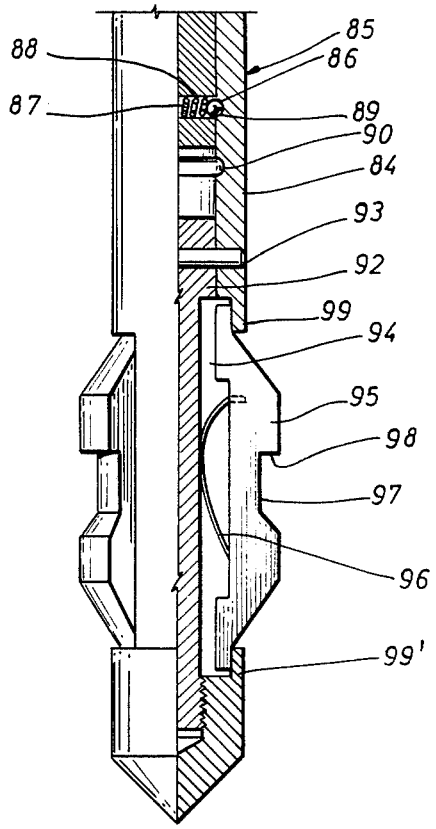

The running tool assembly 30 that is adapted to be lowered into the pipe string 14 and operated to make an electrical connection with the contact pins 39 is shown in FIGS. 4A and 4B. The assembly 30 includes an inner body section 80 having a sub 81 connected to its upper end by a nut 82, the sub being threaded to a bridle 83 by which the running tool is suspended on the electrical wireline 31. The body section 80 is telescopically disposed within an outer body section 84, and is movable between upper and lower longitudinally spaced positions with respect thereto. The body section 80 is releasably held in either the upper or the lower position by a detent mechanism indicated generally at 85, which may comprise ball latches 86 that are spread apart by a coil spring 87 that is received in a transverse bore 88 in the lower end of the body section 83. Alternatively the detent machanism may include generally rectangular dogs that are urged in opposite directions by the spring 87. The balls 86 can engage in an upper annular groove 89 or in a lower annular groove 90 in the body section 84 to correspondingly releasably hold the body sections in either one of the two longitudinally spaced relative positions. The lower end of the body section 84 is connected to a mandrel 92 by a pin 93 or the like as shown in FIG. 4B. The mandrel 92 has oppositely facing recesses 94 that receive laterally movable locator dogs 95 that are urged outwardly by leaf springs 96 or the like. Each dog 95 has an external recess 97 that provides a downwardly facing shoulder 98 which functions to stop downward movement of the running tool in the housing assembly 22 when the dogs are positioned adjacent the stop ring 25. Retainer flanges 99 and 99' function to limit outward movement of the dogs 95.

Oppositely disposed and upwardly extending arms 102 are mounted on pins 103 to the outer body section 84 for pivotal movement between inner or retracted positions where the arms are received within longitudinally extending slots 104 in the body section, and outer or extended positions where the upper end portions 105 thereof extend outwardly into sliding engagement with the inner wall surfaces of the housing assembly 22. Each arm 102 is biased outwardly by a coil spring 112, however the upper end thereof normally is held in the retracted position by a lock ring 106 that is driven underneath an inclined locking surface 107 on the lower end of each arm by a power spring 108 that reacts between an upwardly facing shoulder 109 on the inner body section 80 and the lower end surface 110 of the lock ring 106. With the inner body section 80 in its upper position with respect to the outer body section 84, the power spring 108 acts upwardly on the lock ring 106 with sufficient force to cause its rounded upper surface 111 to be shifted upwardly underneath the lower end portions of the arms below the pivot pins 103 to thereby swing the arms inwardly to their retracted positions. When the inner body section 80 is in its lower position with respect to the outer body section 84, the compression of the power spring 108 is relieved to enable the lock ring 106 to shift downwardly as the expander springs 112 exert outward force on the arms 102.

The upper end section 105 of each arm 102 is inclined with respect to the main portion thereof so as to be substantially parallel to the inner wall surfaces of the housing assembly 22 when the arms are in their extended positions. A socket 115 is fixed within a bore 116 in each end section 105 and is arranged to mate with one of the male pins 40 on the contacts 21 when moved upwardly into engagement therewith. Conductor wires 117 lead from the sockets 115 through bores 118 in the arms and into a central bore 120 of the inner body section 80 where the same are coupled by a feed-through connector 112 to the conductor wires in the electrical cable 31 on which the running tool is suspended.

OPERATION

The test tools assembled substantially as shown in the drawings are run into the well, and the packer 11 is set by appropriate manipulation of the pipe 14 to isolate the well interval to be tested. As described in the aforementioned U.S. Pat. No. RE 29,638, the main test valve 15 is opened in response to the application of pressure at the surface to the well annulus, and the valve is left open for a flow period of time that is sufficient to draw down the pressure in the isolated interval. Then the pressure being applied is relieved to enable the valve 15 to close and shut in the test interval. As the test valve 15 is operated, pressure data is sensed by the transducer 17 and recorded by the gauge 18. The test valve 15 can be repeatedly opened and closed to obtain additional data as desired by repeatedly increasing and releasing the pressure being applied to the well annulus. When it is desired to readout at the surface the data stored in the gauge 18, the running tool 30 assembled as shown in FIGS. 4A and 4B is attached to the electric wireline 31 and lowered into the pipe string 14. The inner body section 80 of the running tool initially is stationed in its upper position with respect to the outer body section 84, where it is releasably held by engagement of the detent balls 86 with the upper annular groove 89. In this position the power spring 108 forces the lock ring 106 under the lower end portions of the arms 102 to cause them to pivot inwardly to retracted positions alongside the outer body section 84.

Figure 5A:
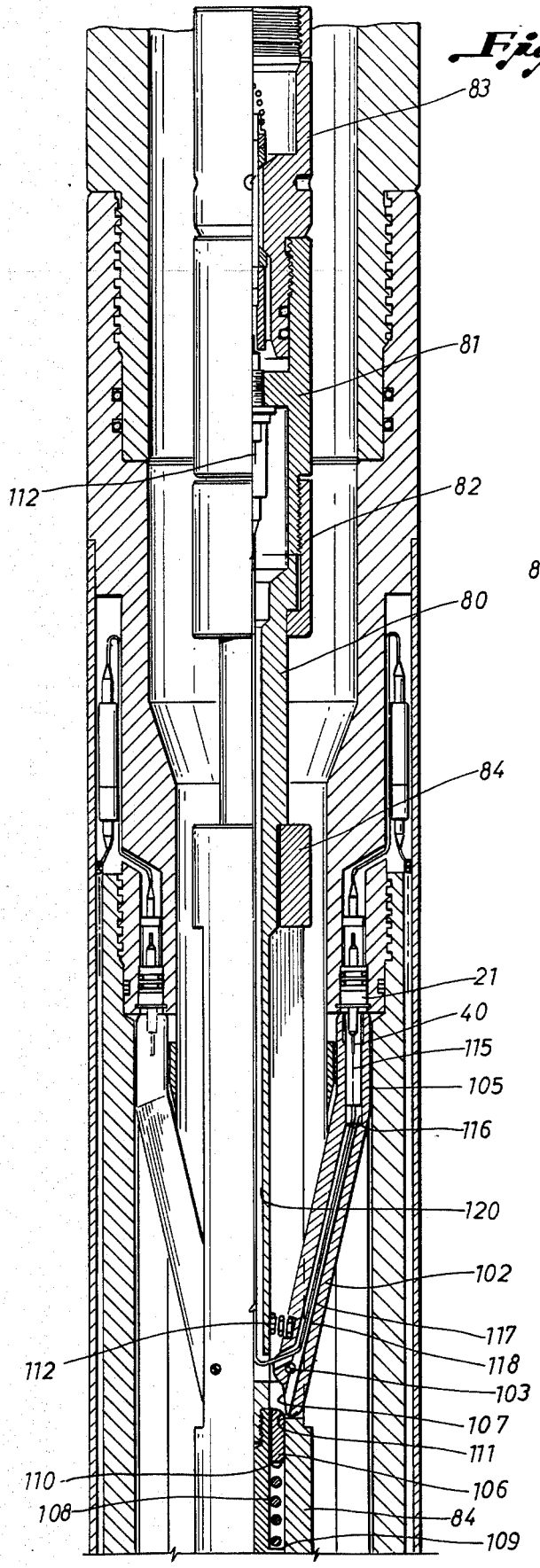
FIGS. 5A and 5B are sectional views showing the running tool of FIG. 4 positioned inside the bore of the receiver housing member.
Figure 5B:
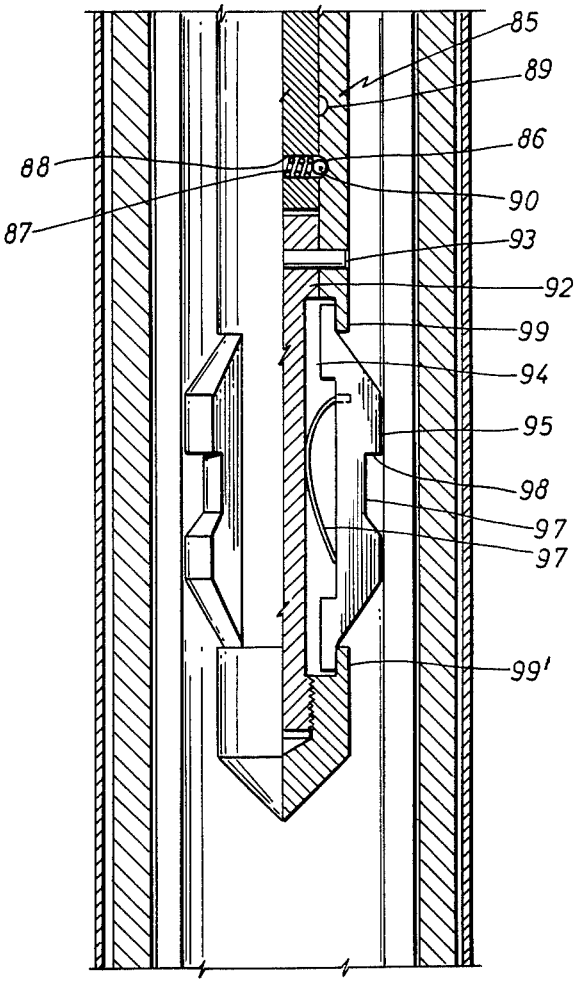

As the running tool 30 is lowered into and down through the extension housing 22, the locator dogs 95 eventually will engage the stop ring 25 to prevent further downward movement as the shoulders 98 and 59 come into contact. Then a downward force is applied to the inner body section 80 by jarring or the like to cause the detent balls 86 to disengage from the upper groove 89 and enable the inner body section to shift downwardly to its lower position with respect to the outer body section 84 where the detents 86 engage in the lower annular groove 90 as shown in FIG. 5B. Such downward relative movement relieves the compression on the power spring 108 and enables the lock ring 106 to be shifted downward as the arms 102 are urged outwardly by the expander springs 112. The upper ends of the arms 102 are thus pivoted outwardly until the upper end sections 105 thereof engage the inner wall surfaces of the extension housing 22.

Then the running tool 30 is raised upwardly within the housing assembly 22. The upper end surfaces of the arms 102 engage the helical guide surfaces on the "mule-shoe" arrangement shown in FIG. 2B, which cause rotation of the entire running tool assembly until the arms are vertically aligned with and enter the slots 45 in the housing member 36. The upper sections 105 of the arms travel upwardly through the slots 45 until they enter the bores at the upper ends thereof, whereupon the sockets 115 engage the pins 40 to make the electrical connections as shown in FIG. 5A. Once upward movement of the outer body section 84 of the running tool is stopped by engagement of the arm sections 105 in the bores, further upward movement of the inner body section 80 can be effected to "recock" the tool, with the detent balls 86 being repositioned in the upper annular groove 89 and the power spring 108 placed under compression.

With the electrical connections made as previously described, the data stored in the recording gauge 18 can be read out at the surface via the cable 31. When it is desired to disconnect the electrical connections and remove the running tool 30 from the well, weight is imposed thereon to shift the arm sections downwardly and out of engagement with the pins 40 and the bores 21. The power spring 108, having been placed in compression as described above, forces the lock ring 106 upwardly under the lower sections of the arms 102 which causes them to pivot inwardly against the bias of the expander springs 112 to their retracted positions. Then the running tool 30 is free to be moved upwardly and out of the housing assembly 22, and can be removed from the well by withdrawing the wireline 31.

Although the present invention has been described in connection with an annulus pressure operated tool system that typically is used in testing offshore wells, the invention is equally applicable to a mechanically operated test tool system having a full-bore main valve that is opened and closed in response to manipulation of the pipe string 14, whether used inland or offshore.

It now will be recognized that a new and improved full-bore drill stem testing apparatus has been provided that includes means to enable a concurrent surface readout of measurements made downhole while the test is in progress and the tools are in the hole. Since certain changes or modifications may be made in the disclosed embodiment without departing from the inventive concepts involved, it is the aim of the appended claims to cover all such changes and modifications falling within the true spirit and scope of the present invention.

What is claimed is:

1. Apparatus adapted for use in well testing comprising:

a tubular housing having an open bore therethrough;

a downwardly facing recess in the wall of said housing laterally offset from and opening into said open bore;

a first electrical contact mounted in said recess; and guide means below said recess for guiding a second electrical contact carried by an associated running tool upwardly through said opening into said recess and into engagement with said first electrical contact.

2. The apparatus of claim 1 wherein said guide means includes an elongated channel extending vertically along the wall of said housing; and orienting means for causing said second electrical contact to enter the lower end of said channel during upward movement in said housing.

3. The apparatus of claim 2 further including a stop mounted within said housing below said orienting means for enabling actuation of said associated running tool that carries said second electrical contact.

4. The apparatus of claim 3 further including a transducer mounted in said housing, and a conductor extending along said housing externally of said open bore for electrically connecting said first electrical contact with said transducer, said transducer being adapted to sense a well fluid characteristic such as pressure or temperature and to provide an output indicative thereof.

5. Apparatus adapted for use in well testing comprising:

upper and lower tubular housing members adapted for connection to a pipe string, said lower housing member having a flow passage and valve means for opening and closing said flow passage; said upper housing member having an open bore in communication with said flow passage;

diametrically opposed, downwardly opening recesses in the wall of said upper housing member laterally offset from and opening into said open bore;

a first electrical contact mounted in each of said recesses; and guide means below each of said recesses for respectively guiding second electrical contacts carried by an associated running tool upwardly through said openings into said recesses and into engagement with said first electrical contacts.

6. The apparatus of claim 5 wherein said guide means includes elongated slots extending downwardly below each of said recesses, and orienting means for causing said second electrical contacts to respectively enter the lower ends of said slots during upward movement of said electrical contacts in said upper housing member.

7. The apparatus of claim 6 further including a stop mounted within said upper housing member below said orienting means for enabling actuation of said associated running tool that carries said second electrical contacts.

8. The apparatus of claim 7 further including transducer means for sensing a characteristic of formation fluids in said flow passage below said valve means and providing an output indicative thereof, and a conductor for electrically connecting said transducer means with said first contacts, said conductor extending along said upper housing member externally of said open bore.

9. Apparatus adapted for use in making a releasable electrical connection in a well comprising:

a tubular receiver having an open bore and a downwardly directed recess in the wall section thereof and opening into said open bore;

a first electrical contact mounted in said recess;

a guide extending longitudinally on the wall of said receiver below said recess and leading thereto;

a running tool assembly adapted to be lowered into said receiver and having an arm pivotally mounted for movement from an inner position to an outer position, said arm having a second electrical contact on the upper end thereof arranged to mate with said first electrical contact;

releasable means for locking said arm in said inner position while the running tool is being run into the well;

means for releasing said locking means to enable pivotal movement of said arm to said outer position in response to movement of said running tool in said receiver; and means operable during upward movement of said running tool in said receiver for orienting said arm to enter said guide, whereby said second electrical contact can be moved into mating contact wilth said first electrical contact.

10. The apparatus of claim 9 wherein said orienting means comprises a sleeve member having helical surfaces on the lower end thereof arranged to provide an entrance to the lower end of said guide.

11. The apparatus of claim 10 further including a stop on the inner walls of said receiver below said orienting means, said stop being cooperable with a locator on said running tool assembly for enabling actuation of said releasing means.

12. The apparatus of claim 9 wherein said running tool assembly includes an inner body section telescopically disposed within an outer body section and movable between upper and lower positions with respect thereto, said arm being pivotally mounted on said outer body section.

13. The apparatus of claim 12 wherein said locking means is operable in said upper position of said inner body section and said releasing means is operable in said lower position of said inner body section.

14. The apparatus of claim 13 wherein said locking means comprises a member cooperable with an inclined surface on the lower end of said arm, spring means for biasing said member upwardly against said inclined surface when said inner body section is in said upper position, said member being movable downwardly with respect to said inclined surface when said inner body section is in said lower position.

15. The apparatus of claim 9 wherein said arm has an upper portion and a lower portion, said upper portion being directed at an angle with respect to said lower portion such that in said outer position the longitudinal axis of said upper portion is parallel to the longitudinal axis of said running tool assembly.

16. An orienting apparatus comprising a sleeve member having diametrically opposed, longitudinally extending slots in the wall thereof; first guide means for guiding an arm of an associated well tool into one of said slots including first and second oppositely extending helical surfaces on the lower end of said sleeve member, said first surface being substantially longer than said second surface and extending below the lower end of said second surface; and second guide means for guiding an arm of an associated well tool into the other of said slots including third and fourth surfaces on the lower end of said sleeve, said third surface being an extension of one side wall of said other slot and said fourth surface being a helical surface sloping downwardly and away from said third surface.

17. The apparatus of claim 16 further including longitudinally extending flow channels in the walls of said sleeve member intermediate said slots.

18. The apparatus of claim 16 wherein the lower ends of said second and fourth surfaces are joined by a rounded nose surface, the lowermost point of said rounded nose surface being located at an angle of less than 90° from a radial line that intersects the longitudinal centerline of said one slot.

19. The apparatus of claim 18 wherein a beveled surface joins the respective lower ends of said first and third surfaces.

20. A running tool apparatus for use in making an electrical connection in a well comprising:

an inner body section telescopically disposed with respect to an outer body section;

means for connecting said inner body section to an electrical cable by which the apparatus may be lowered into the well;

at least one arm pivotally connected to said outer body section in a manner such that the upper end thereof is movable from a retracted to an extended position;

a contact carried by said upper end of said arm;

means for urging pivotal rotation of said arm to said extended position;

means for preventing such pivotal rotation; and means responsive to downward movement of said inner body section relative to said outer body section for disabling said preventing means to thereby enable movement of said arm to said extended position.

21. The apparatus of claim 20 wherein said arm has an upper portion and a lower portion, said upper portion being inclined with respect to said lower portion at an angle such that when in said extended position the longitudinal axis of said upper portion is substantially parallel to the longitudinal axis of said inner body section.

22. The apparatus of claim 20 wherein said arm has an extension on the lower end thereof that projects below the point of pivotal connection to said outer body section, said extension having a downwardly and outwardly inclined inner surface, said preventing means comprising a member movable relatively along said inner body section adjacent said extension and having an external surface engageable with said inclined inner surface.

23. The apparatus of claim 22 wherein said preventing means further includes a coil spring reacting between said inner body section and said member, whereby upward movement on said inner body section relative to said outer body section compresses said spring to force said external surface of said member against said inclined inner surface.

24. The apparatus of claim 23 further including detent means for releasably holding said inner body section in an upper position relative to said outer body section and in a lower position relative to said outer body section to correspondingly compress said spring and prevent said pivotal rotation and relieve the compression in said spring to enable movement of said arm to said extended position.

25. The apparatus of claim 20 further including outwardly biased locator means on said outer body section for stopping downward movement of said apparatus at a predetermined location in a well conduit.

26. Well test apparatus providing for surface readout during testing of a measured downhole condition, comprising:

a tubular member having a full bore fluid passage therethrough and adapted for connection above a full opening test valve in a pipe string that extends from an isolated interval to the surface of the well;

a first electrical contact exposed to said bore and located annularly thereof on said tubular member and in a nonobstructive position with respect thereto;

means for sensing a well condition below said valve;

means for establishing electrical connection between said sensing means and said first contact;

a running tool adapted to be lowered into said pipe string from the surface on an electrical cable;

a second electrical contact located annularly on said tool and serving to provide electrical connection to said cable;

means for locating and latching said running tool within said tubular member; and means operable when said tool is located in said tubular member for causing said second contact to mate electrically with said first contact, whereby electricalsignals indicative of said well condition can be transmitted to the surface via said cable.

* * * * *